US005419562A

United States Patent [19]

Cromarty

[11] Patent Number: 5,419,562

[45] Date of Patent: May 30, 1995

[54] METHOD AND APPARATUS FOR ANALYZING MOVEMENTS OF AN INDIVIDUAL

[76] Inventor: John I. Cromarty, P.O. Box 422, Old Saybrook, Conn. 06475

[21] Appl. No.: 104,985

[22] Filed: Aug. 10, 1993

[51] Int. Cl.[6] ..... A63B 69/00

[52] U.S. Cl. ..... 273/183.1; 273/186.1; 273/186.4; 434/247; 434/252; 482/902

[58] Field of Search ..... 273/183.1, 186.1, 187 R, 273/26 R, 186.4; 482/902; 434/247, 252

[56] References Cited

U.S. PATENT DOCUMENTS

| | | | |
|---|---|---|---|
| 3,895,366 | 7/1975 | Morris | 273/183.1 |
| 4,137,566 | 1/1979 | Haas et al. | 364/410 |
| 4,163,941 | 8/1979 | Linn, Jr. | 273/186.1 X |
| 4,304,406 | 12/1981 | Cromarty | 273/186 R |
| 4,891,748 | 1/1990 | Mann | 364/410 |
| 5,056,783 | 10/1991 | Matcorich et al. | 273/26 R |
| 5,111,410 | 5/1992 | Nakayama et al. | 364/555.01 |
| 5,118,112 | 6/1992 | Bregman et al. | 273/183 A |
| 5,154,427 | 10/1992 | Harlan et al. | 273/186.3 |
| 5,249,967 | 10/1993 | O'Leary et al. | 434/247 |

*Primary Examiner*—Vincent Millin
*Assistant Examiner*—Kerry Owens
*Attorney, Agent, or Firm*—Alfred E. Miller

[57] ABSTRACT

In method and apparatus for analyzing motion of an individual for a predetermined activity, such as during a golf swing, forces on weight pads supporting the individual's feet are converted to signals corresponding to relative weights and dynamic forces on the weight pads. These parameters are displayed numerically as well as graphically on a video image of the individual during performance of the activity, in order to enable the analysis of variation in weight distribution and dynamic forces during the activity.

8 Claims, 4 Drawing Sheets

METHOD AND APPARATUS FOR ANALYZING MOVEMENTS OF AN INDIVIDUAL

FIELD OF THE INVENTION

This invention relates to a method and apparatus for analyzing weight and force parameters on the feet of an individual, for example for sport activities. While the invention will be specifically disclosed primarily with respect to the analysis of weight distribution and dynamic forces on the feet of a golfer during a golf swing, it will be apparent that the invention is also useful in the analysis of the weight distribution on the feet of an individual engaged in other activities, such as, for example only during the swing of a baseball bat or a tennis racquet, while kicking a football or soccer ball, while throwing a baseball or football, etc, as well as other activities wherein the weight on the feet of the individual shifts during the activity. The invention is thus not limited to the specific sporting activity of the individual.

BACKGROUND OF THE INVENTION

The importance of the providing an indication of the distribution of weight on the feet of a golfer for analysis of the golf swing has been recognized. For example, as disclosed in my U.S. Pat. No. 4,304,406, separate weight pads have been provided for the left and right feet in a golf training and practice apparatus. In this system, a video screen was provided that displayed the weight, in the form of relative weight distribution, at predetermined determinable times during a golf swing. For example, it was possible to determine the time at which the ball was being addressed, prior to the swing. The top of the swing was detectable when the weight on the right foot was a maximum. The time of impact of the ball, during the swing, was also detectable by the covering of certain sensors by the head of the club. Accordingly, the apparatus provided means for displaying the weight distribution on the feet of the user that had occurred at these specific times.

While the display of the weight distribution at these three times was useful, it did not enable a full analysis of the transfer of weight between the feet of the individual during the swing. In addition, prior systems did not consider the measurement of dynamic forces on the feet of the individual.

SUMMARY OF THE INVENTION

It is therefor an object of this invention to provide a method and apparatus enabling the display and analysis of the weight distribution on the feet of an individual during the entire period of an activity, such as a sporting activity, in which the manner in which the weight distribution on the feet of the individual varies may be indicative of the suitability of the motion of the individual during such activity.

It is also an object of the invention to provide a method and apparatus enabling the display and analysis of dynamic forces on the feet of an individual during the period of an activity, such as a sporting activity.

Briefly stated, the present invention is directed to the provision of an electronic apparatus and method for using the apparatus, wherein the weight distribution between the right and left feet of an individual is continuously measured while performing one or more functions such as, but not limited to, the swinging of a golf club, a baseball bat, hockey stick, tennis racquet, etc., or jumping or other various movement involving foot or leg activity.

Numeric data corresponding to this weight distribution is superimposed in numeric and graphic form on a video image of the individual's performance during execution of the movement. The combined video display can be viewed directly and/or optionally recorded on a standard video cassette recorder for subsequent analysis. It is of course apparent that other display devices may be employed for the display, such as LED displays, LCD displays, etc.

The apparatus includes a source of signals corresponding to the weight on the left and right feet of the individual, such as a pair of weight-sensing platforms, one for each foot. An electronic circuit converts the instantaneous electrical outputs of the platforms to numeric data and a computer-controlled video graphic system synchronizes the video display with the camera generated image of the individual, to superimpose the percent weight distribution in both numeric and graphic form on the video display.

The video display of the individual may be obtained in conventional manner with a video camera, and the system incorporates a video display monitor for displaying the superimposed images.

The video display is simply a video image of the individual, as seen by the video camera. The information supplied by the apparatus is superimposed on a predetermined portion of the display so as not to obscure the individual's image. The information derived by the apparatus can be displayed totally in various forms or not at all, or moved to different locations on the video screen.

The graphic display appears as a pair of superimposed line graphs, one line for each foot. The lines are preferably distinguishable, for example being of different colors or shapes (for example on a monocolor screen). In addition, the lines may be provided with a distinct color when the weight on the respective weight pad corresponds to 50% of the weight of the individual. Each line graph presents a display of the weight on that foot for the past two seconds and the display is updated once per video frame by scrolling the existing graph to the left and entering the new data on the right. The time of the display can be longer or shorter than two second, as desired.

The numeric display shows the percent weight distribution for each foot. The values which are displayed are preferably exponentially weighted moving averages normalized to 100% in order to minimize the need for calibration and to reduce apparent noise in the display.

A third number, the deviation of the sum of the current right and left readings from the current average of the two is also displayed. This reading is a measurement of dynamic force on the feet of the individual, and is an indicative of instantaneous vertical accelerating or decelerating force on the weight pads.

A variable grid or other reference image is also generated to be located at a position, with respect to the image of the individual on the screen, to aid in the evaluation of the individual's initial stance and motion during the swing.

BRIEF DESCRIPTION OF THE FIGURES

In order that the invention may be more clearly understood, it will now be disclosed in greater detail with reference to the accompanying drawings, wherein.

DESCRIPTION OF THE PREFERRED EMBODIMENTS

Figure 1:
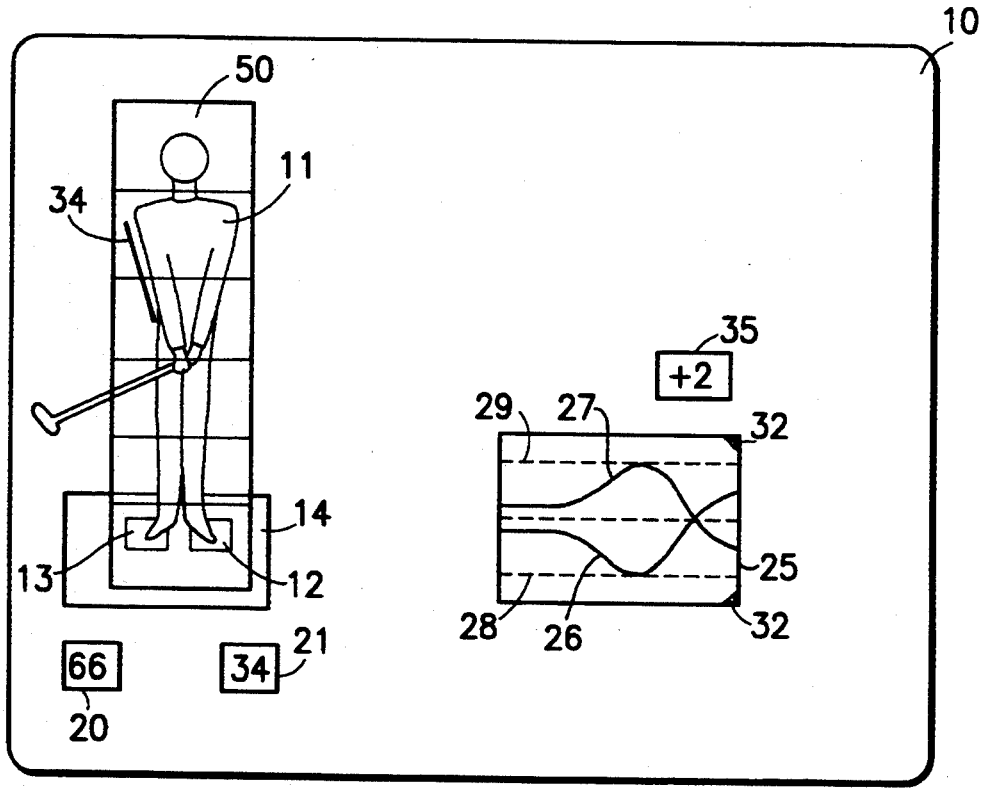
FIG. 1 is a simplified drawing of the display screen of an apparatus in accordance with the invention, illustrating parameters of a golf swing.

Referring now to the drawings, FIG. 1 is an illustration of an instantaneous display on a video screen that may be produced with the apparatus of the invention. This display includes a background portion 10 that is a conventional video image of an individual 11 during a golf swing. The video image shows the feet of the individual on separate right and left weight pads 12, 13, for example mounted on a platform 14. As illustrated, the image of the individual may be displaced from the center of the screen in order to enable the display of additional information related to the golf swing, as will be discussed. The background portion 10 is thus the recorded image of the individual taken during a golf swing, and may be recorded in conventional manner, for example with a camcorder or any other video recording instrument.

It is of course apparent that this image is recorded in a direction with respect to the individual that enables a clear view of the movement of the individual during the entire golf swing. Thus, FIG. 1 illustrates a frontal view of the individual. Other directions of viewing of the individual may also be useful, and, in a modification of the invention, the background may include several spaced apart view of the individual taken from different directions in order to show, for example, both the front and side view of a golfer during a golf swing. The direction and number of views provided on the background image portion, as well as the positions of the views, thus may be optionally selected in order to convey the desired information about the parameters of the swing.

In accordance with the invention, additional information is superimposed upon the background image portion 10, as follows:

1. Numerical display insets 20 and 21 are provided that display the relative weight distribution on the right and left feet of the individual, respectively. For convenience in analysis, these insets are preferably positioned in the proximity of the display of the respective weight pad upon which the individual stands during the swing. The numbers that are displayed are preferably exponentially weighted moving averages of the weight distribution, normalized to 100% in order to minimize the necessity of calibration, as well as to reduce apparent noise in the display.

Figure 2:
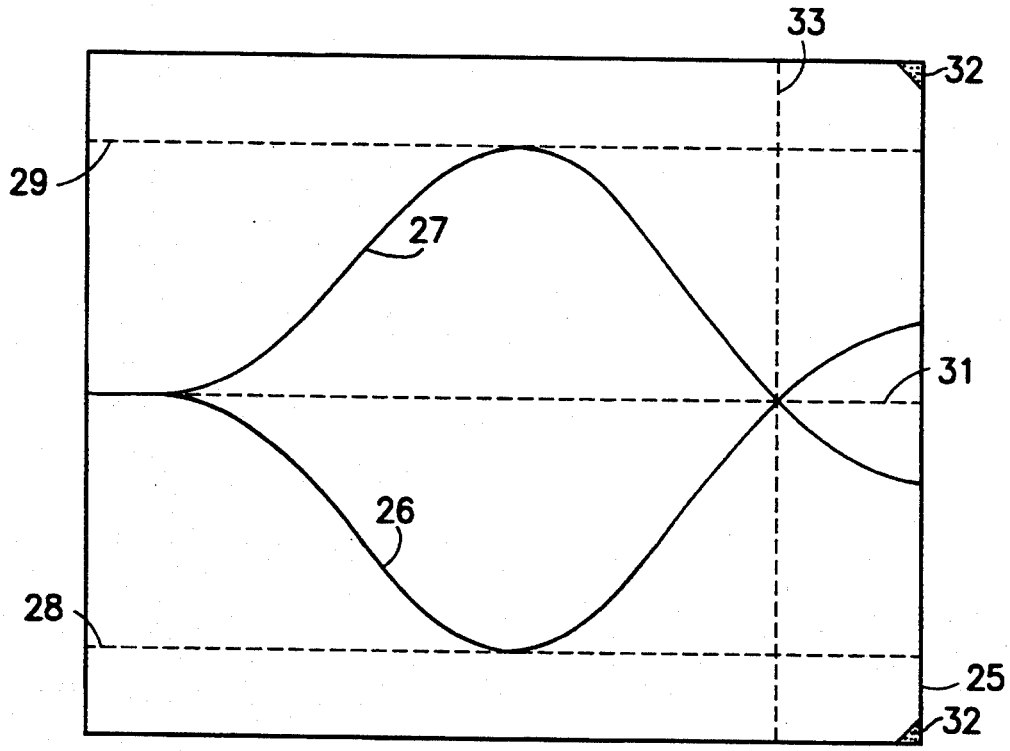
FIG. 2 is an enlarged view of one of the insets of the display screen of FIG. 1.

2. A graphical inset 25. This display is a moving graphic display of two lines 26, 27 corresponding to the forces applies to the left and right feet, respectively, of the individual. This inset is illustrated more clearly in the enlarged view of FIG. 2. A horizontal line 28 is displayed in the inset 25 spaced upward a short distance from the bottom of the inset, and another horizontal line 29 is displayed in the inset 25 spaced downward a short distance from the top of the inset 25. The line 28 corresponds to the zero weight on the respective weight pad, and the line 29 correspond the 100% of the weight of the individual.

When the individual is standing still on the weight pads, with the weight generally divided equally between the right and left feet, each weight pad senses 50% of the weight of the individual. The display for this condition is represented at the left hand side of the inset 25 in FIG. 2, at position 30, wherein each of the lines 26 and 27 is located halfway between the zero weight line 28 and the 100% weight line 29. The 50% weight position is thus illustrated by the horizontal line 31. This position need not be specifically indicated on the inset. The still weights on the left and right weight pads is normalized so that the sum thereof corresponds to the distance between the reference lines 28 and 29. For example, if the individual shifts his or her weight so that all of the weight is on the right foot and none is on the left foot, the graphic line 26 corresponding to forces on the left foot will be at the vertical level of the zero weight percent line 28, and the graphic line 27 corresponding to forces on the right foot will be at the vertical level of the 100% weight line 29.

The weight or force data is displayed in the inset 25 so that the current instantaneous values are displayed at the right hand side of the inset 25, aligned with the displayed markers 32. The markers 32 may be arrows, if desired. As new current data is received from the weight pads, the display is controlled to move the earlier data to the left, so that each of the lines 26, 27 depicts the respective weights for a given period of time. The lines 26, 27 thus present a moving temporal display of the forces applied to the right and left weight pads, weights on the feet of the individual.

The graphic line display is thus moved at a predetermined rate, so that the lines display the instantaneous relative weights for a predetermined period of time before they are displaced off the inset at the left side thereof. It has been found that controlling the moving the points of the lines at a speed such that each instantaneous position is displayed continuously for about two seconds, before it is moved off the left side of the display, is quite satisfactory. Depending upon the activity that is being imaged, the display time of each instantaneous weight may controlled to be in the range of from one to four seconds, if desired. Thus, the speed of movement of the points on the graph and/or the size of the graph may be varied to display either a larger or smaller temporal segment.

3. A numerical display inset 35 that displays the deviation of the sum of the current right and left readings of force applied to the weight pads from the current average of these right and left readings. This reading is indicative of instantaneous vertical accelerating or decelerating force on the individuals feet. This number thus represents a dynamic vertical force that may be either greater or less than the true weight of the individual. This feature of the invention will be discussed in greater detail later in this disclosure.

4. A grid 50 is located on the video image at a position that enables analysis of actual movement of the individual during a golf swing. Such a grid is preferably centered upon the position of the individual 11 on the display portion 10. This grid serves as an aid in the evaluation of the individual's initial stance and motion during the swing. The grid is preferably movable by an operator in order to enable locating it at a position to simplify the analysis of the movement of the individual. Similarly, the size and shape of the grid may be variable, as well as the number of grid lines, for the same purpose.

Instead of, or in addition to, the grid 50, marks, icons, or other references may be superimposed on the image, such as the line 34 aligned with an arm of the individual, for example by means of a conventional light pen. Such marks, etc, may be employed to further simplify the analysis of movement of the individual during a swing.

Figure 3:
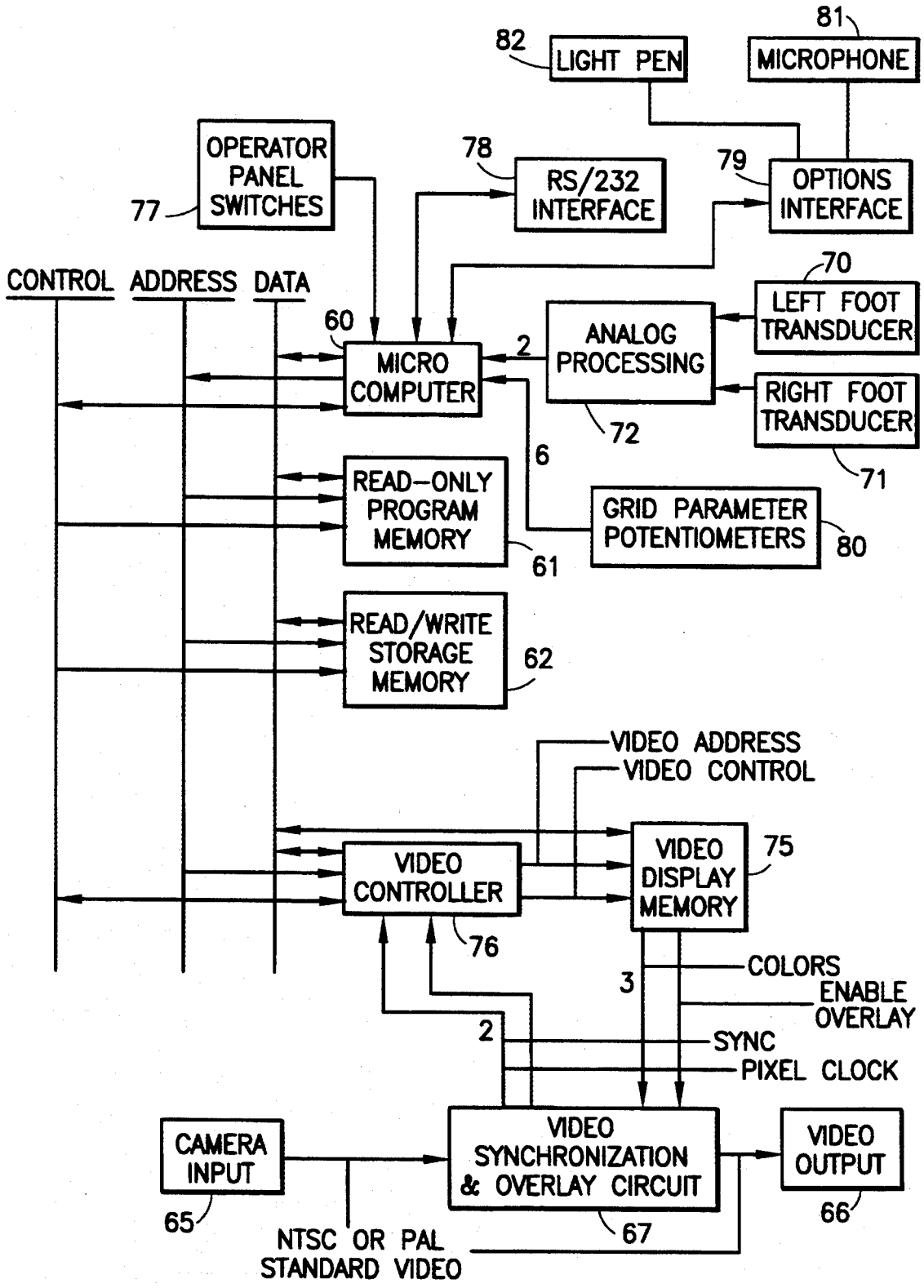
FIG. 3 is a block diagram of an apparatus in accordance with the invention.

FIG. 3 is a block diagram of a system that may be employed in accordance with the invention. This system is controlled by a microcomputer 60 coupled, along with its program memory 61 and RAM 62 to control, address and data buses in conventional manner. Conventional video signals of the individual during the execution of a golf swing, produced for example by a video camera, at camera input 65, are directed to a video output port 66 via a synchronization and overlay circuit 67. The video output signals may be stored on a video cassette, for example, for later display and analysis. The video synchronization and overlay circuit 67 synchronizes the overlay signals with the camera signals to be superimposed thereon. The video output signals at block 66 thus represent an image corresponding to the current movement of the individual whose motion is being analyzed.

The system further includes the left and right foot transducers 70, 71, which may be in the form of weight pads adapted to support the left and right feet of the individual. These pads, which may be of the type disclosed in my U.S. Pat. No. 4,304,406, produce analog output signals proportional to the weight applied to the respective pad. These signals are filtered in the analog processor 72, and the resultant analog signals are applied to analog inputs of the microcomputer 60. The microcomputer processes these signals to produce left and right relative weight signals proportional to the percentage of weight that is applied to the respective weight pads, as well as dynamic force signals as discussed above. The use of relative weights avoids the necessity for calibration of the system.

The microcomputer applies the relative weight signals to the video display memory 75 via a video controller 76, in order to establish synchronization between the camera signals and the relative weight signals. The relative weight signals produced by the microcomputer are in the form of numeric input signals, for displaying the numeric weight signals at insets 20, 21, and in the form of graphic signals for display at the graphic inset 25. The signals calculated and output by the microcomputer also produce the numeric inset display 35.

Potentiometers 80 are connected to analog inputs of the microcomputer in order to enable the operator to control the generation of the grid 50 for superimposition on the video display, the grid signals generated by the microcomputer also being stored in the video memory 75. The system may include further function control switches 77, for example for controlling the enabling or disabling of any of the video insets, and/or for controlling inputs and output via an RS/232 interface 78 and an options interface 79.

The RS232 interface and an options interface 79 are part of the configuration that will allow parallel use of the weight data to be viewed, for example on the screen of the apparatus of my above U.S. Pat. No 4,304,406, and also to allow the printing of desired data originating in the apparatus of the invention.

In accordance with a further function of the invention, the option interface may be connected to a microphone 81 or the like for detecting the sound that occurs at the instant of an impact with an object such as a ball, hockey puck, etc. The instant that the sound occurs may be displayed in the inset 25, for example by displaying a vertical line 33 that coincides with the positions of the lines 26, 27 at the time of impact. The apparatus of the invention may be provided with an output, for example via the options interface 79, for coupling to a recorder for recording such sound in real time. An interface with a separate printer can be employed to allow data to be sent from the apparatus of the invention to be printed in a conventional printer. In addition, a light pen 82 may be coupled to the microcomputer in order to enable the display of further reference lines on the display, as discussed above. A mode switch may be provided on the computer to enable the selecting, deleting or moving of the data on the screen, as well as to enable providing additional data on the screen.

The system in accordance with invention has proved to be extremely useful in analyzing the details of an individual's swing, diagnosing problems, and improving an individual's technique. It is especially valuable when used with a training and practice apparatus such as the system disclosed in my above U.S. Pat. No. 4,304,406, because qualitative and quantitative information about the swing can be related to quantitative information about the results of the swing.

Figure 4:
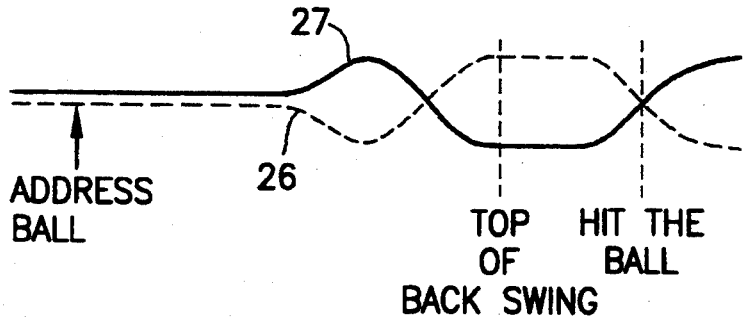
FIG. 4 is a line chart showing weight distribution during a full golf swing.
Figure 5:
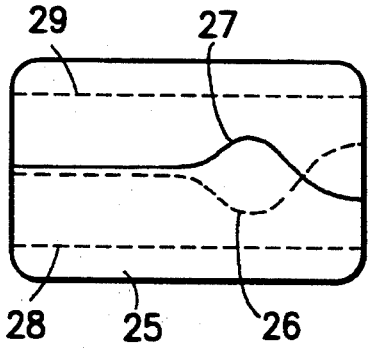
FIG. 5 is a view of the inset 25 showing weight distribution during a swing.

FIG. 4 is a simplified line graph illustrating relative weight variation on the left 26 and right 27 feet during a typical golf swing. It is seen that the positions at which the ball is being addressed, the position at the top of the back swing, and the position at which the ball is impacted, may be clearly identifiable. FIG. 4 depicts the portion of the graph of FIG. 5 that may appear in the inset 25 at the instant that the club has reached the top of the back swing. It is thus seen that the graph clearly shows how the weights on the two feet have varied between the time of the start of the swing and the time that the top of the back swing has been reached. The optimum curves for each part of the swing may be determined empirically, to serve as a comparative guide for the individual in order for the individual to improve his or her swing. Other portions of the swing than that shown in FIG. 5 may of course be similarly analyzed.

As discussed above, when the individual is standing perfectly still on the weight pads, the sum of the weights sensed by the two weight pads will be equal to the total weight of the individual. This sum may differ from the total weight of the individual due to dynamic forces, however, when the individual moves. For example, during the backstroke of the golfswing, the individual must use force to counteract the mass of the club head. This results in the storing of energy in the bending of the shaft, to produce a positive reaction on the force that the individual applies to the weight pads. When the backswing is finished, a lot of energy must be exerted in order to reverse the direction of the club head. This energy results causes the club shaft to bend and store energy. It is desirable that the bending of the shaft be maintained until the club head impacts the ball, so that as much as possible of the energy will be transferred to the ball to result in as long a flight of the ball as possible.

If this flexing or bending of the shaft is not maintained during substantially the entire downswing until the time of impact of the club head with the ball, so that the hands of the individual slow down, the shaft will "unload". Such unloading frequently occurs at about the time that the arms of the individual are opposite his or her knees. As a result, energy stored in the shaft and club head is released, thereby producing a substantial vertical dynamic force on the individual. This results in the application of a large force on the weight pads prior to the time of impact of the club head with the ball.

I have found that, for an optimum swing, with as much as possible of the kinetic energy of the club head being employed to impel the golf ball, that the dynamic forces sensed by the weight pads should be as low as possible, for example only a few percent of the weight of the individual, and should occur as late in the golf swing as possible. Dynamic forces caused by improper control of the swing may cause substantial sensed weight variation, for example 30 or more percent of the actual weight of the individual.

Such early release of the energy not only affects the energy transferred to the ball and the speed of the club head at the time of impact, but may also affect the club face angle and the club head path at the time of impact. Thus, at the start of the downswing, the club head trails the axis of the club shaft. Upon a slow down of the swing prior to impact, the energy stored in the club head may cause the shaft to flex so that the club head is in front of the axis of the shaft. Such flexing may result in the club head face being at a different angle to the ball, at the time of impact, as well as a change in the desired path of the club head at this time, than if the pre-release of energy had not occurred. When the individual, through the course of the downswing and backswing, raises or lowers his body or laterally moves his body right or left, this will also result in causing a negative or positive dynamic force to occur. This body movement will readily be detected by the use of the grid 50 previously described.

Figure 6:
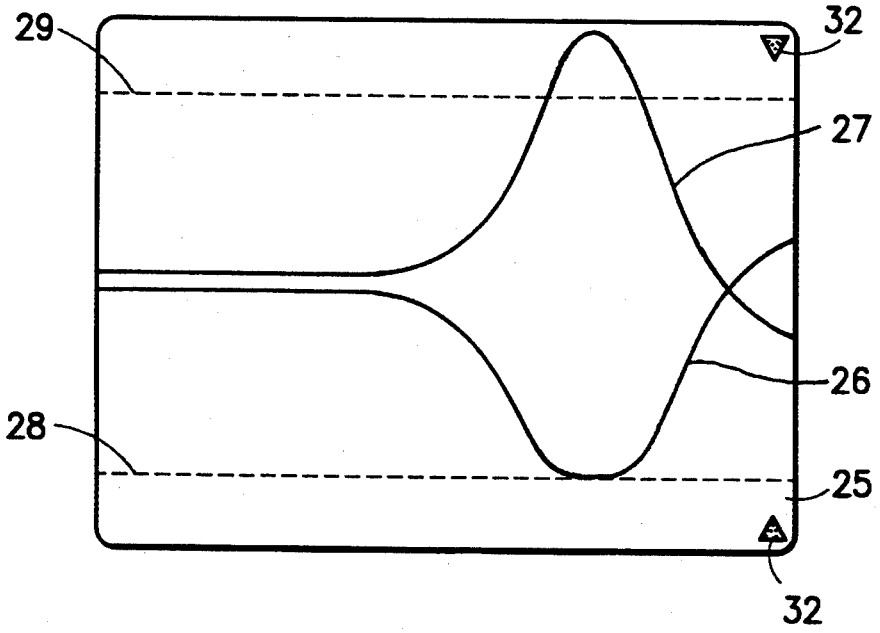
FIG. 6 is a further view of the inset 25 illustrating the detection of dynamic force.

The dynamic forces that are displayed in the graphic inset 25 and the numerical inset 35 are a thus a function of the downward pressure on the weight pads. The dynamic force that is numerically displayed is negative if the total sensed force is less that 100% of the weight of the individual, and positive if it is more than the total weight of the individual. The presence of dynamic force is evident when the weight lines 26, 27 go above the 100% line 29 or below the zero percent line 28. Thus, as illustrated in FIG. 6, the weight line 27 extends above the 100% line 29 during a part of the swing, due to dynamic forces. The graphic display inset 25 thus shows not only the existence of the dynamic force, but also which foot it is on.

Figure 7:
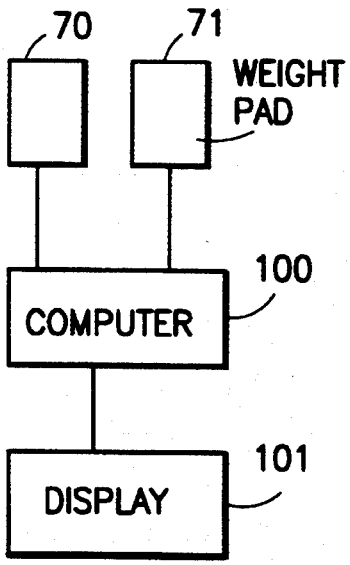
FIG. 7 is a block diagram of a modification of the system of the invention.

In a modification of the invention, as illustrated in FIG. 7, a simplified apparatus may be provided for analyzing substantially only the dynamic forces on the weight pads 70, 71. In this arrangement, the outputs of the weight pads are applied to a computer 100 which calculates the dynamic forces in the above discussed manner. The results of the calculations are applied to a simple display device, such as an LCD panel 101. This display panel may be simply an alphanumeric display panel, in which case the computer 100 may be programmed to display only the maximum dynamic force that has been applied to weight forces during the golf swing. Other alphanumeric data may also be displayed on the panel 101, as discussed above, if desired. The display panel 101 may also include the capacity for a graphic display, as discussed above.

The apparatus depicted in FIG. 7 may be sufficiently inexpensive that it can be employed for analysis by an individual at home, or in a commercial establishment for determining the desirable golf club configuration for the individual, i.e. the swing weight, shaft flex, location of the flex point along the shaft and face angle of the club head.

Figure 8:
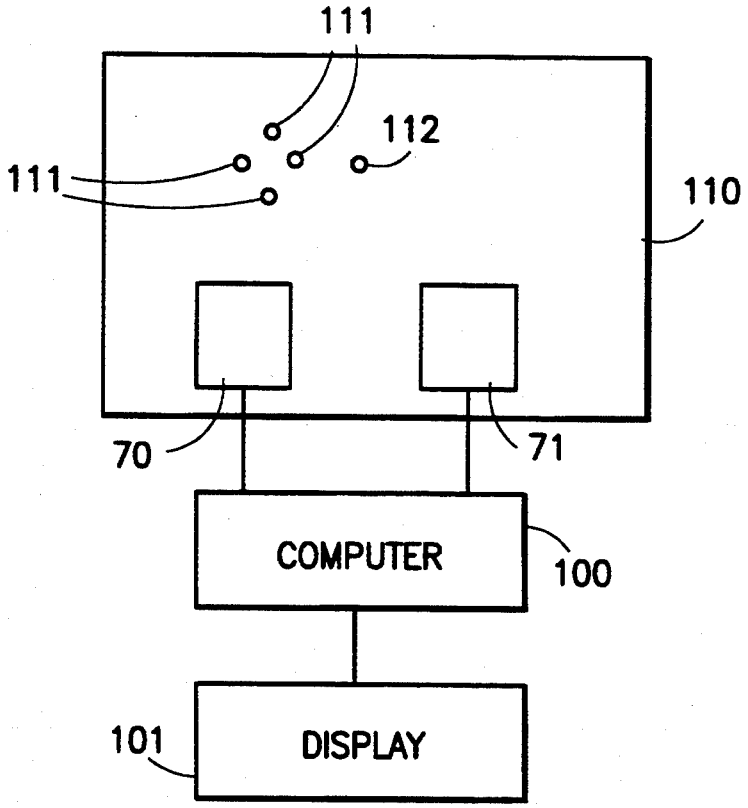
FIG. 8 is a block diagram of a modification of the system of FIG. 7.

The apparatus of the present invention may be further modified to include or all of the features of the apparatus described in my U.S. Pat. No. 4,304,406. For example, FIG. 8 illustrates a modification of the apparatus of FIG. 7, wherein the weight pads 70–71 are mounted on a base 110 that also has a small number of golf club sensors 111 positioned adjacent a tee position 112. These sensors are coupled to the computer 100 by connectors (not illustrated), to enable the computer 100 to also determine club head speed and face angle. These additional parameters may be displayed in alpha numeric and/or graphic form on the display panel 101. It is of course evident that many other variations of the system of the present invention are possible.

While the invention has been disclosed and described with reference to a single embodiment it will be apparent that changes and modifications may be made therein, and it is therefore intended in the following claims to cover each such variation and modification as falls within the true spirit and scope of the invention.

What is claimed is:

1. An apparatus for producing signals for display on a display screen for analyzing motions of an individual during a pre-determined activity in which said individual is standing on right and left weight pads for supporting separate feet of said individual comprising; a source of background video signals on said display screen corresponding to a video image of said individual during said activity; a graphical inset on said screen having a graphic line display of first signals on said graphical inset corresponding to forces on the feet of the individual, said display including a pair of lines on said graphical inset forming a display segment in which each of the lines depicts a moving temporal display of the respective weight on the right and left weight pads for a period of time of one to four seconds before said display segment is displaced off the left side of said inset and another segment of said lines appear on said graphical inset, and means for superimposing said pair of lines on said background signals, and means for storing and outputting said background signals with said pair of lines superimposed thereon.

2. The apparatus as claimed in claim 1 further comprising means on an inset on said display screen for alphanumerically displaying the relative vertical forces on the feet of said individual, and means for numerically displaying deviations between the current forces on said feet and an average of forces on said feet for a predetermined period.

3. The apparatus as claimed in claim 1 wherein each line graph presents a display of the weight on the respective foot for approximately two seconds and thereafter the existing line graph is scrolled to the left while a new line graph appears from the right on said inset.

4. The apparatus as claimed in claim 1 further comprising means for producing reference video signals corresponding to a fixed reference image, said background video signals corresponding to a video image of an individual during a predetermined activity, means for superimposing said reference video signals on said background video signals, said means producing reference video signals which includes means for producing signals that correspond to a grid, and said means for superimposing said grid signals on at least one portion of said background signals that correspond to said individual, and means for modifying the portion of said background signals upon which said reference video signals are superimposed.

5. A method for producing a display on a display screen for analyzing motion of an individual in which said individual is standing with his right and left feet on right and left weight pads respectively during a predetermined activity, comprising:

(a) producing a background display on a display screen of said individual during said activity, (b) superimposing a pair of lines on a graphical inset forming a display on said display screen in which each of the lines depicts a moving temporal display showing the respective weights on the right and left weight pads for a predetermined period of time of at least one second before a display segment is displaced off the left side of said inset and another display segment of said pair of lines appears on said graphical inset, (c) said step of superimposing a graphical display includes superimposing mutually distinguishable line graphs corresponding separately to forces on said left and right feet during activity, (d) said step of superimposing line graphs comprises inserting line graph data on one side of said inset on said display screen, (e) and continually moving the display of line graph data toward an opposite side of said inset whereby the instantaneous line graph data is superimposed on said background display for a predetermined time period during said activity.

6. The method as claimed in claim 5 wherein said predetermined time period is one to four seconds.

7. In a device for analyzing an activity of an individual, in which said individual is standing on right and left weight pads wherein means are provided for producing first signals corresponding to the vertical forces on the feet of said individual on both said left and right weight pads, the improvement comprising a pair of lines on a graphical inset forming a display in which each of the lines depicts a moving temporal display of the respective weight on said right and left weight pads for a period of one to four seconds before the display is displaced off the left of said inset, and another segment of said lines appears on said graphical inset.

8. The apparatus as claimed in claim 7 further comprising an alphanumeric inset on said display screen which shows deviations between current forces applied to said feet of said individual and the average of forces applied to said feet for a predetermined time period.

* * * * *